US006012464A

United States Patent [19]

Hollowell et al.

[11] Patent Number: 6,012,464

[45] Date of Patent: Jan. 11, 2000

[54] HAIR PERMING AID

[76] Inventors: Regeina A. Hollowell; Jack L. Hollowell, both of 2128 Edwardsville-Galena Rd., Georgetown, Ind. 47122

[21] Appl. No.: 09/251,853

[22] Filed: Feb. 17, 1999

[51] Int. Cl.[7] ..... A61K 7/06; A45D 7/02; A45D 24/00; A45D 2/00

[52] U.S. Cl. ..... 132/202; 132/212; 132/200; 132/221; 132/222

[58] Field of Search ..... 132/202, 212, 132/210, 108, 221, 222, 200

[56] References Cited

U.S. PATENT DOCUMENTS

| | | | |
|---|---|---|---|
| 3,068,874 | 12/1962 | Rapisarda | 132/9 |
| 3,824,844 | 7/1974 | Strickland | 19/10 |
| 4,197,849 | 4/1980 | Bosnick | 128/295 |
| 4,424,911 | 1/1984 | Resnick | 215/365 |
| 4,552,159 | 11/1985 | Fabbri et al. | 132/9 |
| 4,637,411 | 1/1987 | Sanders | 132/9 |
| 5,133,371 | 7/1992 | Sivess | 132/212 |
| 5,456,963 | 10/1995 | Bettany | 428/100 |
| 5,730,161 | 3/1998 | Kohanek | 132/273 |
| 5,874,157 | 2/1999 | Robinson et al. | 428/194 |

*Primary Examiner*—John J. Wilson
*Assistant Examiner*—Rubyn K. Doan
*Attorney, Agent, or Firm*—Joseph N. Breaux

[57] ABSTRACT

A hair perming aid that includes a sheet of litmus paper. The color changing litmus paper is reactive with a hair perming solution such that a readily visible color change occurs when the sheet of color changing litmus paper is saturated with the hair perming solution. The sheets of color changing litmus paper are preferably provided in a long perforated strip wound onto a dispensing roll.

1 Claim, 1 Drawing Sheet

HAIR PERMING AID

TECHNICAL FIELD

The present invention relates to hair perming devices and more particularly to a hair perming aid that includes a sheet of color changing litmus paper; the sheet being placed onto each curling rod after the hair to be curled is wound thereon; the color changing litmus paper being reactive with the perming solution such that a readily visible color change occurs when the sheet of color changing litmus paper is saturated with the hair perming solution.

BACKGROUND ART

Hair salons are typically noisy and confusing places. It is often difficult, therefore, for a hair stylist performing a perm on a client to remember which curling rods wound with hair have been saturated with perming solution and which have not. Failure to saturate the hair on a curling rod with perming solution can lead to a poor perm and an unhappy client. It would be a benefit, therefore, to have a hair perming aid that provided a mechanism for aiding a hair stylist in keeping track of which curling rods wound with hair have been saturated with perming solution. It would be a further benefit to have a hair perming aid that automatically marked each hair wound curling rod as it was saturated with perming solution.

GENERAL SUMMARY DISCUSSION OF INVENTION

It is thus an object of the invention to provide a hair perming aid that provide a visual mechanism for aiding a hair stylist in keeping track of which curling rods wound with hair have been saturated with perming solution.

It is a further object of the invention to provide a hair perming aid that automatically marks each hair wound curling rod as it is saturated with perming solution.

It is a still further object of the invention to provide a hair perming aid that includes a sheet of color changing litmus paper; the sheet being positionable onto a curling rod after hair to be curled is wound thereon; the color changing litmus paper being reactive with the perming solution such that a readily visible color change occurs when the sheet of color changing litmus paper is saturated with the hair perming solution.

It is a still further object of the invention to provide a hair perming aid that accomplishes some or all of the above objects in combination.

Accordingly, a hair perming aid is provided. The hair perming aid that includes a sheet of color changing litmus paper; the color changing litmus paper being reactive with a hair perming solution such that a readily visible color change occurs when the sheet of color changing litmus paper is saturated with the hair perming solution. The sheets of color changing litmus paper are preferably provided in a long perforated strip wound onto a dispensing roll.

In a second aspect of the invention a hair perming method is provided whereby hair is wound onto a curling rod, a sheet of color changing hair curling solution reactive litmus paper is wound around the hair wound curling rod, and saturating the color changing hair curling solution reactive litmus paper and the hair wound around the curling rod is saturated with hair perming solution until the color changing hair curling solution reactive litmus paper reacts with the hair perming solution to change color.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
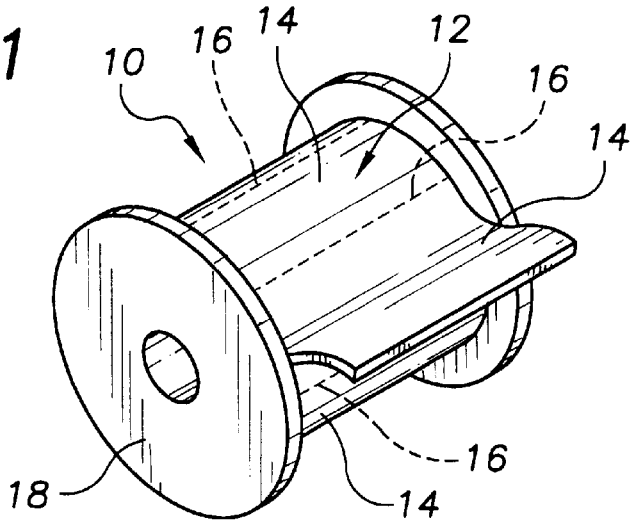
FIG. 1 is a perspective view of an exemplary embodiment of a roll of the hair perming aid of the present invention showing an elongated strip of color changing Litmus paper that is separable into sheets along perforated lines and wound onto a dispensing spool.
Figure 2:
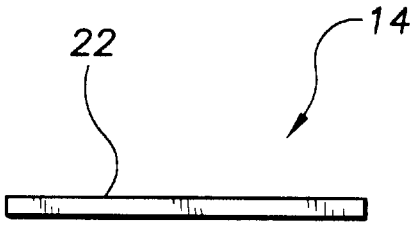
FIG. 2 is an end view of one of the sheets of the roll of the hair perming aid of FIG. 1 showing the color changing litmus paper layer.

FIG. 1 shows an exemplary embodiment of a roll of the hair perming aid of the present invention, generally designated 10. Hair perming aid 10 includes an elongated strip 12 of color changing litmus paper that is separable into sheets 14 along perforated lines 16 and wound onto a dispensing spool 18. With reference to FIG. 2, each sheet 14 includes a color changing litmus paper layer 22. In this embodiment, the litmus paper reacts with the base of the perming solution and changes color.

Figure 3:
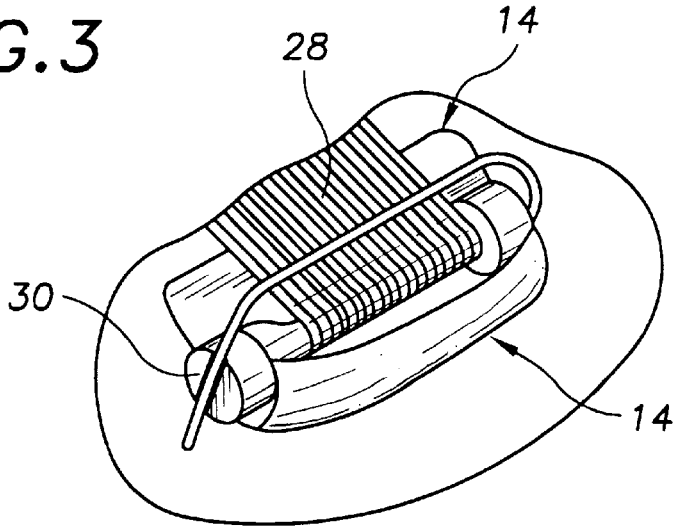
FIG. 3 is detail perspective view showing a representative waft of hair wound onto a curling rod and covered by one of the sheets of hair perming aid of the present invention.

With reference to FIG. 3, in use, a waft of hair 28 to be permed is wound onto a curling rod 30 and covered by one of the sheets 14 of the hair perming aid of the present invention. When hair perming solution is applied to the hair 28 on curling rod 30, sheet 14 changes color alerting the hairdresser that the hair 28 on the curling rod 30 has been treated.

It can be seen from the preceding description that a hair perming aid has been provided that provides a visual mechanism for aiding a hair stylist in keeping track of which curling rods wound with hair have been saturated with perming solution; that automatically marks each hair wound curling rod as it is saturated with perming solution; and that includes a sheet of color changing litmus paper; the sheet being positionable onto a curling rod after hair to be curled is wound thereon; the color changing litmus paper being reactive with the perming solution such that a readily visible color change occurs when the sheet of color changing litmus paper is saturated with the hair perming solution.

It is noted that the embodiment of the hair perming aid described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A hair perming method comprising the steps of:

a) providing a hair perming aid including a sheet of color changing, litmus paper that is reactive with a hair perming solution such that a readily visible color change occurs when the sheet of color changing litmus paper is saturated with the hair perming solution;

b) providing a curling rod;

c) winding a waft of hair around said curling iron;

d) wrapping said hair wrapped curling rod with said perming aid;

e) providing a hair perming solution reactive with said perming aid; and e) saturating said hair wrapped curling rod and said perming aid with said hair perming solution until said color changing hair curling solution reactive litmus paper of said perming aid reacts with said hair perming solution to change color.

* * * * *